United States Patent [19]

Doty

[11] Patent Number: 4,785,273

[45] Date of Patent: Nov. 15, 1988

[54] STRIP-LINE-CORE TRANSFORMER

[76] Inventor: David F. Doty, 701 Burmaster Dr., Columbia, S.C. 29223

[21] Appl. No.: 68,611

[22] Filed: Jun. 30, 1987

Related U.S. Application Data

[63] Continuation-in-part of Ser. No. 716,697, Mar. 27, 1985, abandoned.

[51] Int. Cl.[4] ..... H01F 77/08; H01F 19/00

[52] U.S. Cl. ..... 336/61; 333/25; 333/32; 336/221; 336/223; 336/233

[58] Field of Search ..... 333/25, 26, 32, 33; 336/223, 233, 221, 234, 180, 232, 218, 83, 219, 61

[56] References Cited

U.S. PATENT DOCUMENTS

| | | | |
|---|---|---|---|
| 2,883,604 | 4/1959 | Mortimer | 336/218 |
| 3,020,415 | 2/1962 | Dortort | 336/221 X |
| 3,025,480 | 3/1962 | Guanella | 333/26 X |
| 3,050,634 | 8/1962 | Dortort | 336/221 X |
| 3,195,076 | 7/1965 | Morrison | 336/221 X |
| 3,464,042 | 8/1969 | Raman | 336/221 X |
| 3,766,499 | 10/1973 | Dillenberger | 336/180 X |
| 3,783,415 | 1/1974 | Koskin et al. | 333/25 |
| 3,826,967 | 7/1974 | Wilkinson et al. | 336/232 X |

FOREIGN PATENT DOCUMENTS

| | | | |
|---|---|---|---|
| 1145280 | 3/1963 | Fed. Rep. of Germany | 336/83 |
| 1257907 | 1/1968 | Fed. Rep. of Germany | 336/221 |
| 330589 | 10/1935 | Italy | 336/221 |
| 1188 | 1/1980 | Japan | 336/221 |

OTHER PUBLICATIONS

RCA Technical Notes, "VHF/UHF Balun", Wlasuk, RCATN No. 704, Jan 1967, 336-221.

"Broadband Transformers and Power Combining Techniques for R.F." H. Granberg, AN 749 Application Note, Motorola Semiconductor Products Inc. 1975, pp. 1-10.

*Primary Examiner*—Thomas J. Kozma

*Attorney, Agent, or Firm*—Brumbaugh, Graves, Donohue & Raymond

[57] ABSTRACT

A broadband, high power rf transformer is made by winding a tapered strip-line transmission-line conductor and dielectric material through two parallel slots, formed axially and symmetrically spaced apart, through a solid right cylinder of low loss magnetic material. Low inductance strip lines are used as leads. A thin sheet of high thermal conductivity material may be added in such a way as to augment heat flow with negligible degradation of rf properties. The design is particularly advantageous at frequencies from 1 MHz to 1000 MHz at pulse powers to several kilowatts at impedances from 2Ω to 75Ω.

8 Claims, 1 Drawing Sheet

STRIP-LINE-CORE TRANSFORMER

This application is a continuation-in-part of application Ser. No. 716,697, now abandoned, filed Mar. 27, 1985.

BACKGROUND OF THE INVENTION

The field of this invention is inductor devices, and more particularly, broadband rf transformers for low impedance applications, especially where high power and/or low loss is also a consideration. A typical application is in output matching circuits for broadband rf transistor amplifiers above 30 watts.

The two-hole balun core as shown in FIG. 1 is commonly used for winding broadband rf transformers for use in impedance transformation, or isolation, or both. The primary concern is often to extend the bandwidth with minimum loss; and often power handling capacity, either pulse or continuous wave (cw), is also a concern. Low signal level applications of the two-hole balun core are described in Matsushima U.S. Pat. No. 3,449,704, and Duncan U.S. Pat. No. 4,052,785, for impedance transformations between 50Ω and 300Ω.

The low frequency response is usually limited by the mutual inductive reactance, but often it may be limited by core losses or core saturation. In general, the low frequency pulse power capacity $P_p$ at a given frequency is proportional to the product of the frequency f, the core energy density U, and the core volume V.

$$P_p = \alpha f U V \quad (1)$$

and $$U \alpha B_s^2/\mu \quad (2)$$

where $B_s$ is the saturation flux density of the core and $\mu$ is the core permeability just prior to saturation. The proportionality factor in equation (1) is dependent on core geometry and winding geometry. This factor $\alpha$ is a maximum with closely spaced turns in a toroidal geometry. Broadhead U.S. Pat. No. 3,244,998 describes a method of using transmission line windings to achieve broadband response with a toroidal geometry for impedance transformations between 75Ω and 120Ω. This factor $\alpha$ is also nearly maximum for the D geometry described by Dacen U.S. Pat. No. 3,238,484, in which the flux path is similar to that in the present invention.

Typical nickel-zinc ferrites used in rf transformers have permeabilities ranging from 40 to 250 with typical saturation flux densities from 2000 to 2200 Gauss, while typical carbonyl iron powder materials have permeabilities ranging from 6 to 35 with typical saturation flux densities from 13,000 to 17,000 Gauss. Thus, energy densities of typical nickel-zinc ferrites range from 0.5 to 20μJ/cm$^3$, while energy densities of typical carbonyl iron powder materials range from 4000 to 40,000μJ/cm$^3$. Moreover, the iron powder materials generally have lower losses and better temperature stability. Yet the ferrites are much more widely used for broadband applications because their higher permeability allows higher mutual inductive reactance for a given length of wire, which is significant for broadband considerations.

The optimum conductor geometry is usually that which results in a transmission line impedance equal to the geometric mean of the input and output impedances. Such a condition is easy to achieve with impedances in the range of 20Ω to 200Ω using round wire and common two-hole balun cores, but it is very difficult to achieve at lower impedances using conventional techniques. Consequently, low impedance transformers generally use very small cores with a single turn for the low impedance winding. To simultaneously achieve adequate low frequency response, it has often been necessary to resort to high permeability ferrites with attendant high losses and low saturation flux densities and hence low power capacities. An alternate technique is to combine a number of higher impedance transformers in parallel, thus permitting higher power at low impedance.

The advantages of strip-lines in making low impedance transformers are discussed by Horn and Pitzalis, in U.S. Pat. No. 3,609,613 using a novel spiral winding geometry on a modified toroid core, for impedance transformations as low as 12Ω at frequencies up to 70 MHz. Holdeman U.S. Pat. No. 3,611,233, describes the use of twisted strip-lines on toroid cores for reduced reflections at 1000 MHz. Chesnel U.S. Pat. No. 4,079,324, describes a high power pulse transformer employing bucking strip-line windings to facilitate minimizing parasitic lead inductance for radar pulse modulation at frequencies up to 10 MHz and impedances as low as 1Ω; and Nyswander U.S. Pat. No. 4,092,621, describes the use of strip-line leads, integral with the windings, to reduce parasitic inductance for the same application.

The design guidelines for broadband, high power, low impedance rf transformers can be summed up as follows:

1. Select a core geometry which (A) maximizes inductance for a single turn coil of given length with a core material of given permeability, (B) simultaneously generates relatively uniform flux densities throughout the majority of the central core volume, (C) facilitates the use of low impedance transmission line conductors, and (D) gives a low thermal resistance from the regions of high flux density to the core surfaces.

2. Select a core material which (A) has a high energy density, (B) has a high permeability, (C) has low losses, (D) has low permittivity, and (E) has high thermal conductivity.

The common two-hole balun core scores well on criterion 1A of the above, but poorly on criteria 1B and 1C. The strip-line-core transformer of the present invention, while scoring somewhat lower than the two-hole balun on criteria 1A, scores much better on 1B, 1C, and 1D. Ferrites score better on 2B, but carbonyl iron powders score much better on 2A and 2C.

SUMMARY OF THE INVENTION

A broadband, high power rf transformer according to the invention is made by winding strip-line transmission-line conductor and dielectric material through two parallel slots, formed axially and symmetrically spaced apart so as to form two opposite sides of a cube, through a solid right cylinder substantially of non-conducting magnetic material. Low inductance strip-line leads are appropriately attached to the transmission line turns.

DETAILED DESCRIPTION OF THE PREFERRED EMBODIMENT

Figure 1:
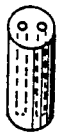
FIG. 1 shows a dual-hole balun core according to the prior art.
Figure 2:
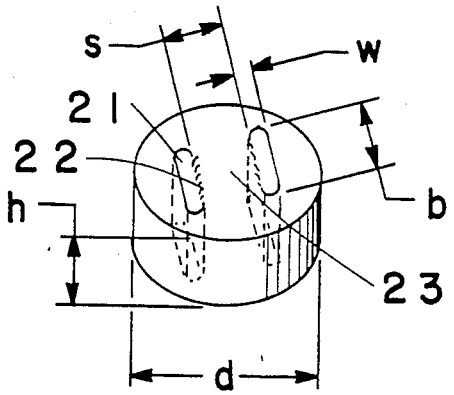
FIG 2 PRIOR ART
FIG. 2 illustrates a strip-line core according to the present invention.

FIG. 2 illustrates a preferred method of achieving the geometric guidelines for a high power, low impedance rf transformer core by means of a slotted right cylinder. The diameter d of the cylinder will typically be about 0.5 cm to 5 cm, depending on power, frequency, and core material. The cylinder height h, the slot 21 spacing s, and the slot length b, are all typically about one-third of the cylinder diameter d. The slot width w is generally made as small as will conveniently accommodate the strip lines, typically about one-fourth of b. The slot edges 22 may be radiused to facilitate manufacturing and winding the transformers and to improve performance. A variety of external shapes other than cylindrical (e.g., rectangular, oval, octagonal) may be used with essentially equal performance. The cubic central region of the core bounded on two sides by the slots will hereinafter be referred to as the coil-core-region 23.

The core material may be of any of the commonly used magnetic materials such as soft ferrites, carbonyl iron powders, or synthetic iron oxides. In most cases, the material of choice will be a high permeability carbonyl iron powder, since the increased inductance available from the ferrites is generally less beneficial than the increased power handling capacity of the iron powders in the low impedance applications for which this design is primarily intended. A particularly advantageous material for the frequency range from 500 KHz to 300 MHz has been found to be the product GQ-4 by GAF Corporation. This product is a phosphate insulated, carbonyl reduced, 99% soft iron powder in the 4 to 6 micron range, and gives a maximum practical relative permeability of about 35 when pressed to a packing fraction of about 0.85 with suitable binders. Powder GS-6 is a similar material, but in the 3 to 5 micron range that allows a maximum relative permeability of about 25 at a packing fraction of about 0.75. It gives somewhat better performance above 80 MHz, but generally poorer performance below 50 MHz. Powder L, a 6–9 micron uninsulated soft iron powder was found to be less satisfactory, even in the 1–3 MHz range, at various packing fractions. Powder W, a 2–4 micron uninsulated hard iron powder was also found to be less satisfactory for transformer applications, even above 150 MHz, at a packing fraction of 0.6.

Figure 3:
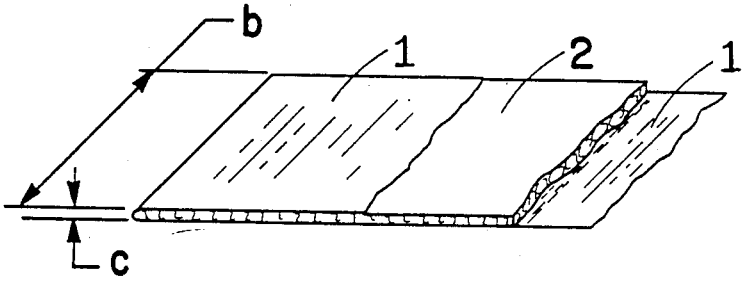
FIG. 3 illustrates a transmission strip-line.

Clearly, the core design of FIG. 2 facilitates the use of the transmission strip-line, as illustrated in FIG. 3. Here, two parallel copper conductor foil strips 1, of width b, are separated by a dielectric material 2 of thickness c. The characteristic impedance $Z_0$ is given in SI units by the following equation:

$$Z_o = \sqrt{\frac{L/l}{C/l}} \tag{3}$$

where L/l is the inductance per unit length and C/l is the capacitance per unit length. For the case of the strip-line with b>>c, we have $$L/l = \mu(c/b) \tag{4}$$

and $$C/l = \epsilon(b/c) \tag{5}$$

thus $$Z_o = \frac{a}{b}\sqrt{\frac{\mu}{\epsilon}} \tag{6}$$

For example, a 12Ω strip-line may be made by using a teflon dielectric of thickness c equal to 0.01 cm and width b equal to 0.2 cm. The thin copper conductor foils should be bonded directly to the dielectric material, such as, for example, the Cuflon material by Polyflon Corporation, which consists of copper electroplated directly onto the surface of specially prepared polytetrafluoroethylene, PTFE.

A parallel wire transmission line, as is commonly used in conventional balun cores, with comparable losses and equal impedance, would require the use of two copper wires, each about 0.3 cm in diameter, separated by a film of PTFE 0.005 cm thick. Hence, the strip-line lends itself much better to low impedance, low loss transmission line.

Not only does the core design of FIG. 2 permit low impedance and low loss transmission lines, it also allows higher power per total volume of the core. The flux density is nearly constant throughout the majority of the central core volume and hence power loss, which depends on $B^2$, is nearly uniform throughout the central core volume, in contrast to the dual-hole balun in which the flux is concentrated around the holes. Thus, the heating is more uniformly distributed and closer to the external surface, and the surface to volume ratio is increased by virtue of the relatively short cylinder height h for increased heat dissipation.

The widespread popularity and success of the two-hole balun is due largely to its high inductance per unit length of wire, which results from the very short round flux paths around the holes. The greater elliptical flux path length in the present invention results in typically about half the inductance of an otherwise similar two-hole balun. Achieving this high an inductance for such a flux geometry requires the additional magnetic material external to the coil-core-region to reduce magnetic reluctance in the flux path. The significance of this feature may not immediately be appreciated without a specific example. Consider the typical E-core, for example, which has a flux geometry similar to that of the present invention.

A typical, small E-core (approx. 2 cm×1.6 cm×0.5 cm) would have a typical central cross sectional area of about 0.25 $cm^2$, with about half that amount, 0.12 $cm^2$, in each side path, and a mean flux path length of about 4 cm. A single foil turn on such a core of permeability 35 has a length of about 2 cm and an inductance of about 35 nH. A typical, small core according to the present invention (1.5 cm ×0.5 cm) would have a central cross sectional area of 0.25 $cm^2$, about 0.2 $cm^2$ in each side path, and a mean flux path length of about 2 cm. A single turn on such a core of permeability 35 has a length of 2 cm and an inductance of 90 nH. Reducing the outside diameter of the core to 1.2 cm while keeping the slot size and spacing the same reduces the cross sectional area of each side path to about half that of the central core region. A single turn on such a core of permeability 35 has a length of 2 cm and was found to have an inductance of 49 nH. Hence, it is clearly advantageous to have the cross sectional area presented to the flux by the coil-core-region substantially less than the mean total cross sectional area outside the coil core region, but ratios less than 0.5 are of marginal value and necessitate additional lead length and poor economy of material utilization. Ratios in the range of 0.5 to 0.7 are generally optimum. In those cases where additional inductance is required, a larger core is generally the best option. Otherwise, two cores may be stacked together, end on end.

Figure 4:
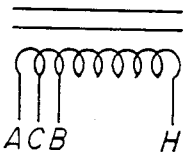
FIG. 4 is a schematic representation of a typical three port, four terminal auto-transformer.

FIG. 4 illustrates schematically a typical four terminal autotransformer that may be used in transistor output stages. Terminals A and B are balanced, low-impedance power inputs (at least at low frequencies with respect to C), and terminal H is the unbalanced high impedance output. Terminal C may be connected to the collector supply Vcc and bypassed to common. A balanced DC current may be present at terminals A and B. Now assume, for example, that the load impedance at terminal H is 50Ω, and the collector impedances are each 4Ω, then the proper transformer ratio would be 1:1:5, since the impedance is proportional to the square of the turns ratio and the parallel source impedance of A and B is 2Ω. The total number of turns would be 6, since the voltages are all referenced to common terminal C.

The low frequency cut-off occurs at the frequency at which the output inductance is equal to the load resistance; or equivalently, when the input inductance equals the source resistance. The inductance in nanohenries of the typical strip-line-core transformer as described above is $$L \simeq 1.6(\mu_r+2)n^2 d \text{ nH/cm} \quad (7)$$

where d is the diameter (cm), n is the number of turns, and $\mu_r$ is the relative permeability. Thus, the transformer of the above example, spiral wound on a strip-line core of relative permeability 35 and diameter 1.5 cm, has an output inductance of 2.1 μH and a low frequency cut-off of 4 MHz.

An adequate approximation for the optimum stripline impedance in a 1:1:n spiral wound strip-line transformer is given by the geometric mean of the three port impedances: 9.3Ω for the above example. The total length of the five turns to the output H in this case is about 11 cm. Thus, the output leakage inductance is only 5 nH, and the effective distributed inter-winding capacitive load at the output is only 2.3 pf (57 pf/$5^2$). The combined effect of these parasitic elements plus propagation delays gives a high frequency cutoff of about 700 MHz. Such an extremely broadband iron-powder core, with 5 KW pulse capability above 10 MHz and 100W cw capability over much of its range, far exceeds the capability of the prior art.

The effective bulk dielectric constant of the typical core material may be as large as 1000, with a loss tangent greater than 1. Thus, the high frequency response will be seriously degraded if care is not taken to isolate the high impedance turn and that terminal from the core by means of a low dielectric spacer and perhaps a ground foil.

The high frequency response may be extended somewhat by using a lower impedance strip-line than previously suggested at the low impedance end, and increasing the impedance at the high impedance end by adding additional dielectric material between the turns there. This is particularly helpful in class AB outputs where the source impedances alternately vary from about half the mean value to nearly infinite on each cycle. The reduced leakage inductance between the two sources is helpful in reducing the high voltage inductive spikes that are generated when the transistors are driven into saturation.

Figure 5:
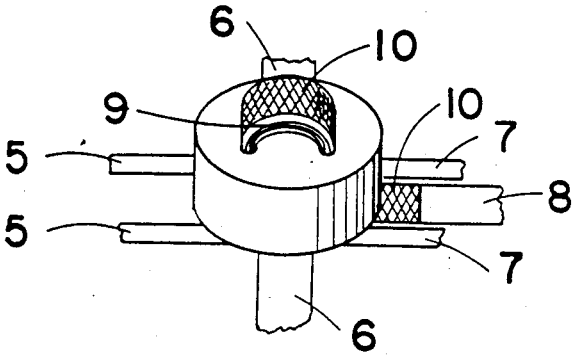
FIG. 5 illustrates a method of using a strip-line core to implement the transformer shown schematically in FIG. 4.

FIG. 5 illustrates an effective method of winding the transformer shown schematically in FIG. 4. A U-shaped copper foil lead 5 is used to form terminal A. Bringing this low impedance terminal out on two parallel legs of a U-foil permits low lead inductance—typically about one nanohenry. The common terminal C is attached to the strip-line, one turn from the low impedance end, and is brought out with a low inductance strap 6 to both sides of the core. The second low impedance port B is brought out from the strip-line on the next turn using a U-lead 7, similar to terminal A. The free, high impedance end of the strip-line 8 is simply brought out to form the high impedance port H. Additional low loss dielectric material 9 may be added between several higher impedance turns to achieve a tapered transmission line. Low loss dielectric material 10 is inserted over the strip-line high impedance turn to reduce dielectric losses in the core. Alternatively, the core may be coated with a low loss dielectric material.

A typical transformer, according to the above described example, was indeed found to have a frequency response of 4 MHz to 700 MHz, and was tested satisfactorily at pulse powers in excess of 1 KW.

Figure 6:
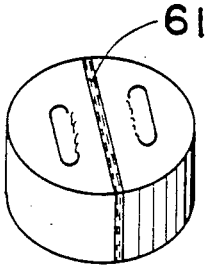
FIG. 6 illustrates a strip-line core with heat flow augmentation.

For very high power applications, it is desirable to augment heat flow from the coil-core region to prevent degradation of the organic binders used in the iron powder core compositions or to keep the magnetic material below its Curie temperature in the case of ferrites. FIG. 6 illustrates a suitable method of heat flow augmentation. A stripline core is bisected along a symmetry plane parallel to the slots not intersected by lines of magnetic flux, and a thin sheet of high conductivity material 61 such as beryllia or silver is laminated between the halves. By not intersecting lines of flux, the effect on low frequency mutual inductance is minimized. Using a thin sheet also helps in this regard and reduces eddy current losses.

This invention has been shown with reference to a preferred embodiment thereof. Variations and modifications will be apparent to persons skilled in the art, and are intended to be within the scope of the following claims.

I claim:

1. A wideband r.f. transformer comprising:

a strip line core (SLC) made essentially from a carbonyl iron powder composite material, said core being defined by two substantially parallel plane surfaces and having two symmetrically spaced apart slots extending between said surfaces and substantially centered thereon;

said slots being spaced apart less than 2 cm and positioned so as to form opposite sides of a substantially void free coil-core-region of substantially square cross section in a plane parallel to said plane surfaces; and a spiral winding of a strip line, consisting of conductor foil and spacer dielectric, threaded through said slots and round said coil-core-region;

said slots being positioned on said surfaces so that the cross sectional area presented to magnetic flux generated by said spiral winding by the coil-core-region is less than 80% of the mean total cross sectional area presented to the flux by the material outside of said coil-core-region.

2. A wideband r.f. transformer in claim 1, in which said SLC is in the form of a right cylinder of height approximately equal to the spacing between said slots and approximately equal to one-third the diameter of said cylinder.

3. A wideband r.f. transformer as in claim 1, in which said iron powder composite material is an insulated soft carbonyl under about 9 microns average size, pressed to a packing fraction of at least 0.75 with rigid binders.

4. A wideband r.f. transformer as in claim 1, in which the inner edges of said slots are radiused so as to form a core-coil-region with a somewhat circular or elliptical cross section in a plane perpendicular to said plane surfaces and to the opposite sides of said core-coil-region.

5. A wideband r.f. transformer as in claim 1, in which a thin sheet of high conductivity material bisects said core along a plane of symmetry for said slots parallel thereto.

6. A wideband r.f. transformer as in claim 1, in which low loss dielectric material is provided between said strip line and said iron powder composite material.

7. A wideband r.f. transformer as in claim 1, in which low impedance taps made of conductive foil in the shape of a U are provided for said spiral winding.

8. A wideband r.f. transformer as in claim 1, in which dielectric material is interposed between turns at one end of said winding to impart a higher characteristic impedance at said one end than at the other end.

* * * * *

UNITED STATES PATENT AND TRADEMARK OFFICE

CERTIFICATE OF CORRECTION

PATENT NO. : 4,785,273

DATED : November 15, 1988

INVENTOR(S) : F. David Doty

It is certified that error appears in the above-identified patent and that said Letters Patent is hereby corrected as shown below:

On the title page, item [76]:

"David F." should be --F. David--.

Signed and Sealed this

Tenth Day of December, 1991

*Attest:*

HARRY F. MANBECK, JR.

*Attesting Officer*

*Commissioner of Patents and Trademarks*